United States Patent [19]

Reibling

[11] Patent Number: 4,504,894

[45] Date of Patent: Mar. 12, 1985

[54] LIGHTING UNIT FOR PROVIDING INDIRECT LIGHT

[75] Inventor: Robert L. Reibling, Fort Thomas, Ky.

[73] Assignee: Whiteway Manufacturing Co., Cincinnati, Ohio

[21] Appl. No.: 206,417

[22] Filed: Nov. 13, 1980

[51] Int. Cl.[3] ..... F21V 7/09; F21V 7/00

[52] U.S. Cl. ..... 362/296; 362/20; 362/33; 362/235; 362/254; 362/276; 362/349; 362/350

[58] Field of Search ..... 362/296, 350, 20, 33, 362/235, 254, 276, 349

[56] References Cited

U.S. PATENT DOCUMENTS

| | | | |
|---|---|---|---|
| 2,600,514 | 6/1952 | Mitchell | 362/350 |
| 3,215,980 | 11/1965 | Adam | 362/296 |
| 3,283,140 | 11/1966 | Rex | 362/350 |
| 3,492,474 | 1/1970 | Yamaguchi et al. | 362/350 |
| 3,679,893 | 7/1972 | Shemitz | 362/350 |
| 3,786,248 | 1/1974 | Compton | 362/296 |

*Primary Examiner*—Irwin Gluck

*Attorney, Agent, or Firm*—Seidel, Gonda & Goldhammer

[57] ABSTRACT

A lighting unit for indirect illumination of an area. The unit has a reflective surface contoured to direct reflected light rays from a source generally upward at predetermined angles for reflection by a surface above the lighting unit providing a symmetrical lighting pattern over the area to be illuminated. The reflective surface is contoured so as to eliminate glare interference to the area to be illuminated by controlling the angle of emanation of the light rays from the lighting unit.

4 Claims, 9 Drawing Figures

FIG. 6
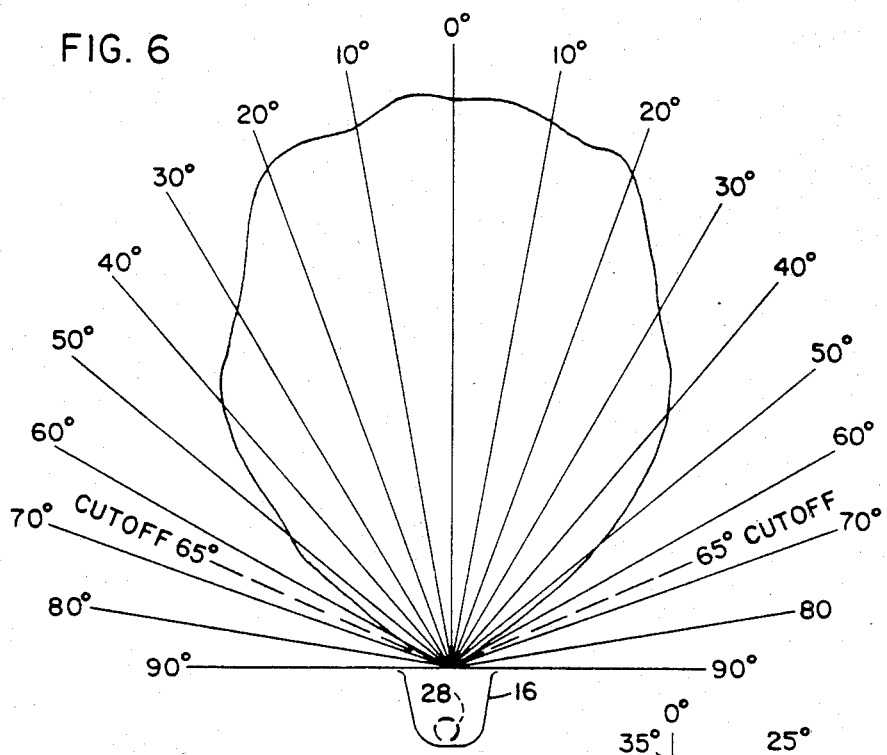
FIG. 7
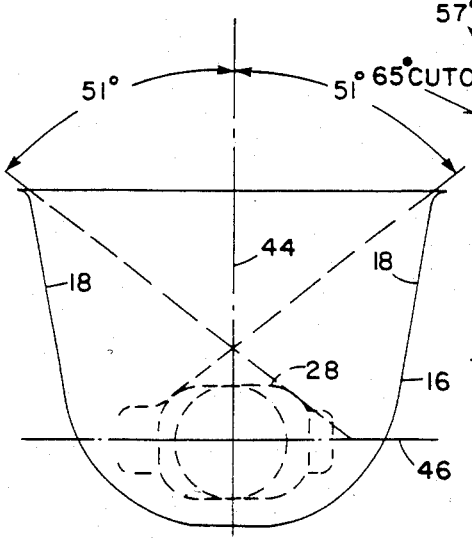
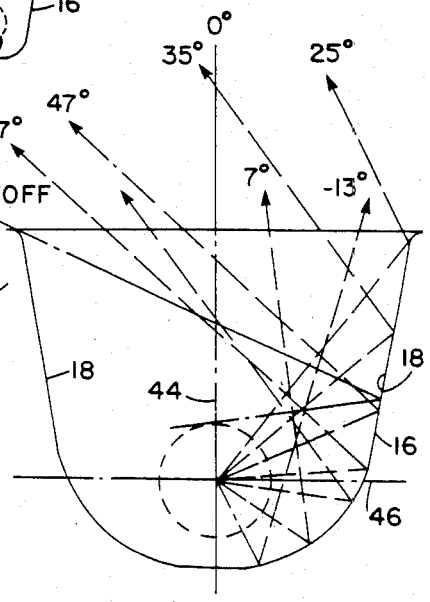
FIG. 8

LIGHTING UNIT FOR PROVIDING INDIRECT LIGHT

BACKGROUND OF THE INVENTION

The present invention is directed to a lighting unit designed to provide illumination of a work area in a room by indirect or reflected light. More particularly, this invention is directed to a luminaire for providing indirect illumination of a work area using a high intensity light source such as a high intensity discharge or metal halide lamp which can be disposed below eye level without glare interference. This type of lighting unit is generally disclosed in U.S. Pat. No. 4,001,575. One problem with prior art luminaires is that the reflectors in the luminaires direct the downward going light rays from the lamp upward to be recombined with the direct light rays from the lamp directly above the luminaire creating a hot spot or more intense area of light. The more intense area of light directly above the lamp in turn provides for a more intense light pattern in an area closer to the luminaire at the level of the work area.

Prior art luminaires or lighting units usually provide a symmetrical lighting pattern covering a full 360° area surrounding the luminaire. However these luminaires are typically mounted above eye level to reduce glare interference due to the dispersion of light coming from them. If mounted below eye level, the uncontrolled light dispersion would create a serious glare effect on the work area. The ideal lighting unit or luminaire should generate a controlled light pattern with high light output. The lighting pattern should have a lower intensity directly above the lamp than would be obtained if the light pattern were not controlled to eliminate the undesirable intense area. The reflector should redirect the light rays from the source so that maximum candle power can be achieved between certain predetermined angles within the desired pattern.

The lighting unit of the present invention generates a 360° symmetric light pattern around the lighting unit. In order to prevent glare interference, the reflector has an increased depth for providing extremely sharp cut-off of light rays beyond a predetermined angle. This permits the lighting unit to be mounted at heights below average eye level without creating undesired glare to the work area or to nearby persons. Mounting below eye level allows for increased distance between the lighting unit and the ceiling. This in turn allows the generated light pattern to be spread over a larger ceiling area and reflected to a greater area or work space.

SUMMARY OF THE INVENTION

The present invention is directed to a lighting unit for indirect illumination of an area. This lighting unit has a light source centrally disposed below the midpoint and within a deep bowl-shaped reflector which is open at the top and surrounds the light source on its other sides and on the bottom. The reflector has a reflective surface which is contoured to direct the reflected light rays from the light source generally upward in a predetermined pattern. The reflective surface directs the reflected light rays away from a vertical axis extending through the focal center of the lighting unit at predetermined angles for reflection by a surface above and spaced from the lighting unit (e.g., a ceiling) at angles similar to the striking angles of the reflected light rays on the surface. The reflection angles are determined to allow the lighting unit to be mounted below eye level without interference of glare from the unit on the work area or on nearby persons.

The reflective surface extends circumferentially around the internal surface of the reflector. It is contoured to redirect or reflect the light rays striking it upward toward the surface above at specific angles measured from a vertical axis through the reflector. These angles are chosen to virtually eliminate glare interference to the work area or to nearby persons even when the lighting unit is mounted below average eye level.

It is an object of the present invention to provide a lighting unit or luminaire that will generate a controlled light pattern with high light output and efficiency.

Another object of the present invention is to allow the lighting unit to be mounted at heights normally lower than average eye level without glare interference to the work area or to persons walking past or standing near the luminaire.

Other objects will appear hereinafter.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 6 is a polar plot showing the accumulative total of the lighting pattern resulting from the shape and contour of the reflector of the lighting unit of the present invention.

FIG. 7 is a schematic illustration of the direct light component of the lighting unit of the present invention.

FIG. 8 is a schematic illustration of the contoured lateral reflective light component of the reflector of the lighting unit of the present invention.

DETAILED DESCRIPTION OF THE INVENTION

Figure 1:
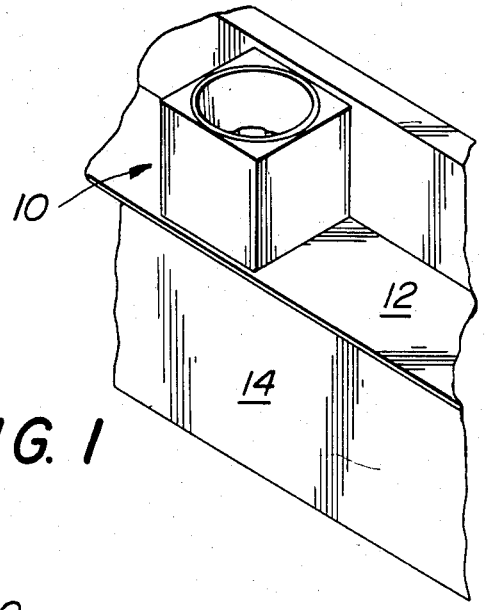
FIG. 1 is a perspective view of the lighting unit of the present invention mounted in a portable housing on a shelf of a room partition.

The present invention is best understood wby referring to the drawings wherein like numerals indicate like elements. Referring to FIG. 1, the lighting unit of the present invention, generally designated 10, can be mounted on a shelf 12 of a room partition 14 or be mounted to the partition 14 by hooking the unit over the top of the partition 14. The partition 14 should be sufficiently tall so as to place the lighting unit 10 at a height below average eye level (usually below a height of 6 feet above the level of the floor). The lighting unit 10 may also be mounted on a stand or on a filing cabinet and placed at any location in a room. The lighting unit 10 can be placed at any height above the work surface as long as a person walking past or standing near the lighting unit is free of glare or light annoyance emitted from the unit. It is preferred, however, that the top of the lighting unit 10 fall in the range of heights having a maximum of 68 inches and a minimum of 56 inches, as measured from the floor, to provide for a glare-free atmosphere while permitting illumination of the desired area.

Figure 2:
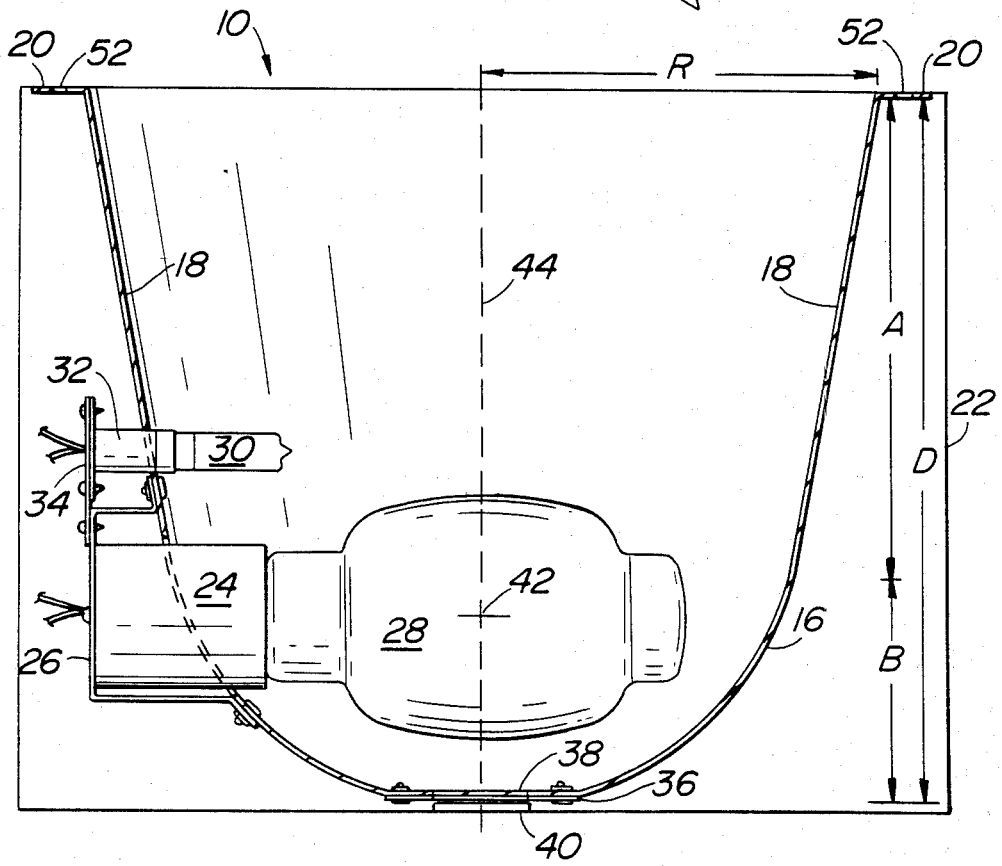
FIG. 2 is a side elevational view of the lighting unit of the present invention capable of housing a 250 W lamp.

Referring to FIG. 2, the lighting unit 10 comprises a deep bowl-shaped reflector 16 having a reflective surface 18. The reflector 16 has a flange 20 at its open end and has four mounting holes 52 to secure the reflector 14 into a housing 22. The mounting holes 52 are used in addition to securing the reflector 16 to the housing 22 for securing a flat glass lens and housing cover (not shown) to the housing 22.

The reflector 16 has a set of punched holes in its lateral wall which are used to mount and secure both the lamp socket 24 and the socket bracket 26 to the reflector 16. The bracket 26 supports the socket 24 so that the lamp 28 is disposed below the midpoint and along the vertical axis of the reflector. The main light source, lamp 28, is preferably a high intensity discharge light source such as a metal halide or a high pressure sodium lamp. It should be noted that while the aforementioned type of lamp is preferred, other lamps can be used. The bracket 34 supports socket 32 for an optional stand-by quartz lamp 30. The bracket 34 is arranged to mount the stand-by lamp 30 above and along the same vertical plane as the main lamp 28. The stand-by lamp socket 32 and stand-by lamp socket bracket 34 are mounted to the main lamp socket bracket 26. All of the sockets and brackets are fastened to each other and to the reflector 14 using any means known per se in the mechanical arts, e.g., riveting, bolting, etc.

The stand-by lamp 30 is an auxiliary or emergency light source which operates when the main lamp 28 fails for any reason. A relay can be connected to the main lamp circuit for sensing momentary voltage interruptions which could extinguish the main lamp 28. If such a voltage interruption occurs, and the main lamp 28 is extinguished, the stand-by lamp 30 will be energized by the relay and provide sufficient light until the main lamp 28 cools and restrikes. As soon as the main lamp 28 restrikes, the sensing relay automatically de-energizes the stand-by lamp 30. Circuits, such as the one described immediately above, are well known in the electrical art and can be implemented using relay or integrated circuit devices.

The reflector 16 has a closure plate 36 mechanically attached to the bottom portion of the reflector. The closure plate can have an opening 38 which is preferred to be 1.125 inches in diameter. The opening 38 serves as a downlight opening allowing sufficient light to project through lens 40 mounted across a similar opening in the bottom of the housing 22. The small quantity of light which passes through the opening 38 can be used for accent lighting of objects, such as figurines and/or plants, placed below a lighting unit hung over a partition or one mounted in a similar manner.

It should be noted at this time that the reflector 16 must be modified in both dimensions, width or diameter and depth, to accommodate different sized lamps. A small reflector can house a 70–250 watt lamp. A large reflector can house a 400 watt lamp. The dimensions of the reflector 16 increase as the lamp size and wattage increase. See Tables 1 and 2. Such related dimensional variations are described hereinafter.

As stated above, the reflector 16 has a reflective surface 18 extending along the lateral internal wall of the reflector. This surface 18 is a specular surface having, by way of example, an engraved chemical surface such as an Alzac anodized finish with a reflectance factor exceeding 83%. The reflective surface 18 is contoured so as to vary the radius of the reflector 16 with respect to its depth measurement. Each of the separately dimensioned reflectors for the differently sized lamps have contoured lateral internal surfaces as set forth in Tables 1 and 2. Specific dimensions of the reflector 16 are described in Tables 1 and 2 for the several embodiments of the present invention; e.g., the 70–250 watt and the 400 watt reflectors, respectively. As shown in FIG. 2, contouring of the reflective surface 18 of the 70–250 watt reflector is divided into two areas; an upper frustoconical portion A and a lower curved portion B. For the 400 watt reflector, the upper portion A is comprised of two frustoconical sections E and F as further described below. The depth of the reflector is denoted by D and the radius measurement by R. Other reference points that will be described more fully hereinafter are the lamp focal center 42 and the vertical axis 44 through the center of the reflector 16. The radius R is varied with respect to the depth of the reflector 16 in order to provide the desired contour to redirect or reflect the light rays striking it from the light source upward at the desired angles.

Preferably, the reflector 16 is a one-piece construction of a spun aluminum alloy. The design of the reflector 16 renders the reflector fully symmetrical about the vertical axis 44. This allows the light generated from the lamp 28 to be utilized to its utmost. Further, the generated light is both controlled and shaped by the design of the reflector 16 to obtain the desired predetermined light pattern.

The light is generated and controlled by two functional components within the reflector 16. These are the direct light component and the reflected light component. Referring to FIGS. 7 and 8, each of these light components is shown respectively. For the ease of explanation of how each light component affects the cumulative total of light from each of the two components, the lamp focal center 42 will be used as the point from which all light rays emanate. By passing a vertical plane through the lamp focal center 42, the behavior of the light rays in that plane can be more easily shown. The light rays comprising these two components in the single plane can be considered an approximation of all of the light rays which emanate from the lamp 28.

The direct light component, as shown in FIG. 7, is allowed to project upward through the upper opening of the reflector 16 through maximum angles of 51° as measured from the vertical axis 44 for a sum of 102°. The direct light component produces a highly efficient but relatively lower intensity light level on a surface above the lighting unit 10 such as a ceiling.

The reflected light component, as shown in FIG. 8, is the redirected or reflected light rays which strike the reflective surface 18 and are projected upward through the opening in the reflector 16 toward the surface above the lighting unit 10. The reflected light rays striking the reflective surface 18 at its open end are reflected at angles of no more than 25° from the vertical axis 44.

When viewing through the opening in reflector 16, only minimal light can be seen from the reflective surface 18 outside the 65° cut-off plane. The reflective surface 18 is contoured to reflect light at a steeper angle as the reflection point moves deeper into the reflector. At a plane near the focal plane 46 of the lamp 28, a distance of 6 inches below the top of the reflector 16, the contour of the reflective surface 18 changes abruptly to a short radial sweep. See Tables 1 and 2 for the changes in radius measurement. This lower curved area of the reflector 16 redirects the light rays upward in angular planes between 0° and 40° as measured from either side of the vertical axis 44. The lateral reflected light component accounts for 258° of the light rays from the lamp 28.

The illumination provided by both the direct and reflected light rays from each of the light components of the reflector 16 results in the desired predetermined lighting pattern. This lighting pattern, as shown in FIG. 6, is plotted in polar form by measuring the intensity of the light in a common plane at various angles as measured from the vertical axis. The graphed line shows uniform intensity of light between 0° and 20° as measured from the vertical axis of the graph. From the graph of FIG. 6, it can be seen that the light has a sharp cut-off of candlepower at approximately 65° from the vertical axis. Almost no light occurs beyond 80° from the vertical axis. The space directly above the lamp 28, which corresponds with the angles of 10° on either side of the vertical axis, has a light power significantly less than the maximum light power. This space between 10° on either side of the vertical axis would normally have a much higher intensity of light causing a "hot spot". Such condition does not exist with the lighting pattern of the present invention. Therefore, the lighting unit 10 of the present invention substantially eliminates "hot spots" from the direct and reflected light components of the lighting unit and provides for a more evenly balanced light intensity over the entire lighting pattern. See FIG. 4.

Figure 9:
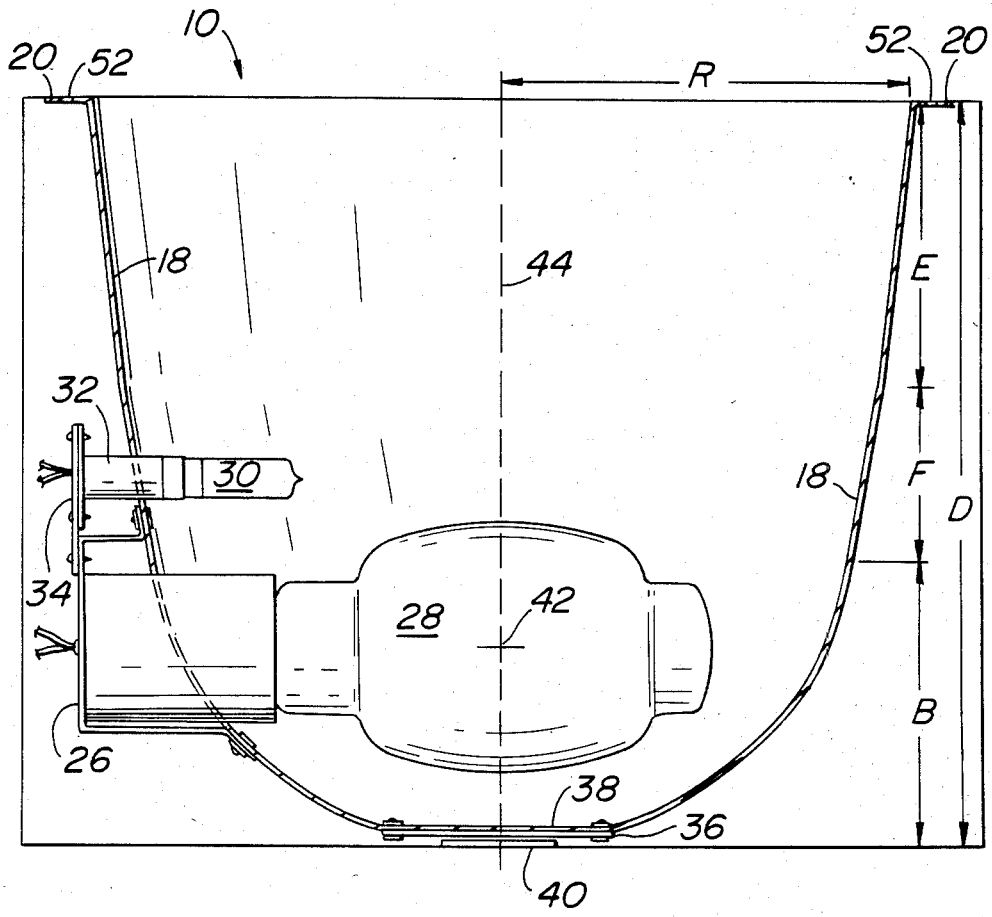
FIG. 9 is a side elevational view of the lighting unit of the present invention capable of housing a 400 W lamp.

In the 400 watt unit, the reflector 16 has two frustoconical surfaces within its upper frustoconical portion A. Referring to FIG. 9, a first frustoconical surface E extends from the top of the reflector 16 to a depth of 5 inches. A second frustoconical surface F, intermediate the first frustoconical surface E and the lower arcuate portion B of the reflector 16, extends from the 5 inch depth to a depth of 8⅛ inches. When the reflector 16 is enlarged to accommodate the larger lamp, the upper portion of the frustoconical surface A must be inclined at an angle more closely approaching that of the vertical axis 44. This upper portion of the frustoconical surface A corresponds to the first conical surface E. The change in angle inclination between the first conical surface E and the second frustoconical surface F is to limit the dispersion of light in order to achieve a light pattern similar to the light pattern for the 250 W reflector. The angle of the first frustoconical surface E permits the light rays striking it to be reflected at angles of no more than 25° from the vertical axis 44. Thus, both the direct and reflected light components in the two reflectors will remain substantially identical with the resulting light pattern also remaining substantially identical to that of the smaller reflector.

Figure 3:
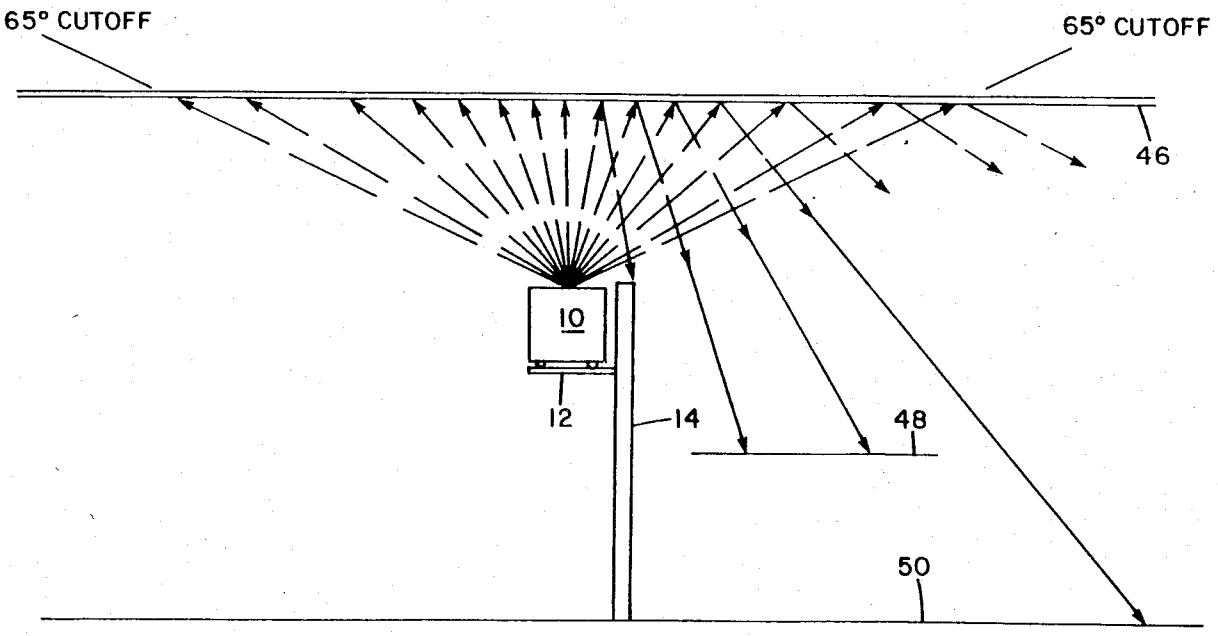
FIG. 3 is a schematic illustration, in elevation, of an arrangement for indirectly lighting an area in accordance with the present invention, specifically illustrating the striking and reflecting angles of the light rays on the surface above the lighting unit and the area to be illuminated.

Referring now to FIG. 3, the lighting unit 10 is shown mounted in phantom on the shelf 12 of partition 14 below a surface 46, such as a room ceiling. The light rays from the lighting unit 10 are directed upward in the lighting pattern described above in order to be reflected from the surface above 46 to a work area such as a desk or table top denoted generally at line 48 or the floor of the room 50. The work area 48 is approximately 30 inches above the floor 50. The predetermined symmetrical lighting pattern resulting from the specific construction of the reflector 16 of the lighting unit 10 provides for controlled light intensity to either or both the work area 48 and the floor 50. The reflected light from the ceiling 46 will be directed across a broad pattern when reaching the work plane 48 or the floor 50. The illustrated light rays shown in FIG. 3 stop angles of 65° as measured from the vertical axis 42. Light rays cannot depart the lighting unit 10 at greater angles to strike the ceiling 46. Therefore, the maximum light intensity to the work area will occur in close proximity to the lighting unit 10.

Figure 4:
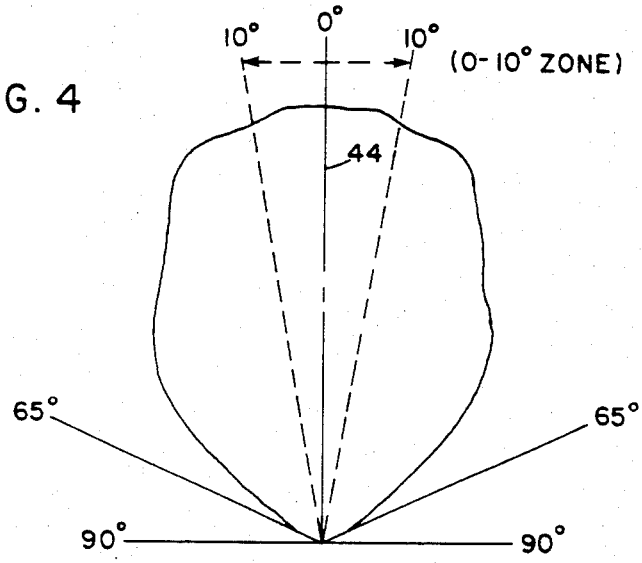
FIG. 4 is a polar plot across the vertical axis of a lighting unit of the present invention having a 250 W light source showing a symmetric light pattern.
Figure 5:
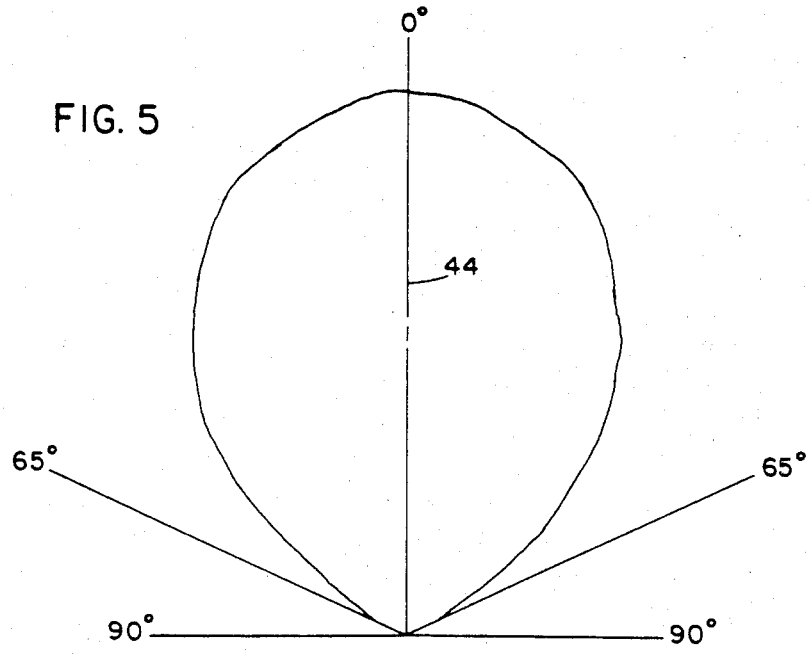
FIG. 5 is a polar plot across the vertical axis of the lighting unit of the present invention having a 400 W light source and a symmetric light pattern.

FIGS. 4 and 5 show the light patterns of the two differently sized reflectors of the present invention in polar form plotted across the vertical axis. FIG. 4 shows the polar light pattern from a reflector 16 which is capable of housing a 250 W lamp. FIG. 5 shows the polar light pattern from a reflector 16 which is capable of housing a 400 W lamp. Both light patterns, while being symmetrical about the vertical axis, show a severe drop in light intensity or candlepower at angles of 65° from the vertical axis. It can, therefore, be readily seen that the present invention provides for the cut-off of light rays beyond angles of 65° thus reducing glare interference significantly to points at or below eye level which are in close proximity to the lighting unit 10.

The lighting unit of the present invention, more specifically the construction of the reflector, provides for the controlled lighting patterns for high light output. The lighting unit makes provision for the elimination of bright spots on surfaces directly above eliminating unwanted glare and non-uniform light intensity to the work area. The lighting unit also provides for a sharp cut-off angle to the light rays emanating from the source so that persons walking past or standing near the lighting unit will not experience high glare or light annoyance. Thus, the lighting unit of the present invention provides a comfortable atmosphere for a person's visual sensing at or near the work area or other area to be illuminated. In addition, due to the portable nature of the lighting unit, it is possible to place the lighting unit of the present invention in any desired position within a room or other area.

The present invention may be embodied in other specific forms without departing from the spirit or essential attributes thereof and, accordingly, reference should be made to the appended claims, rather than to the foregoing specification, as indicating the scope of the invention.

TABLE 1

| 70–250 W Internal Reflective Wall 18: | |
|---|---|
| depth from top of reflector (inches) | radius from vertical axis (inches) |
| 0.000 | 6.078 |
| 0.250 | ↓ |
| 0.500 | ↓ |
| 0.750 | ↓ |
| 1.000 | ↓ |
| 1.250 | ↓ |
| 1.500 | ↓ |
| 1.750 | ↓ |
| 2.000 | ↓ |
| 2.250 | ↓ |

TABLE 1-continued

| 70–250 W Internal Reflective Wall 18: | |
|---|---|
| depth from top of reflector (inches) | radius from vertical axis (inches) |
| 2.500 | ↓ |
| 2.750 | conical |
| 3.000 | ↑ |
| 3.250 | ↑ |
| 3.500 | ↑ |
| 3.750 | ↑ |
| 4.000 | ↑ |
| 4.250 | ↑ |
| 4.500 | ↑ |
| 4.750 | ↑ |
| 5.000 | ↑ |
| 5.250 | ↑ |
| 5.500 | ↑ |
| 5.750 | ↑ |
| 6.000 | 5.015 |
| 6.250 | 4.975 |
| 6.500 | 4.930 |
| 6.750 | 4.875 |
| 7.000 | 4.820 |
| 7.250 | 4.757 |
| 7.500 | 4.680 |
| 7.750 | 4.593 |
| 8.000 | 4.484 |
| 8.250 | 4.359 |
| 8.500 | 4.209 |
| 8.750 | 4.031 |
| 9.000 | 3.835 |
| 9.250 | 3.593 |
| 9.500 | 3.296 |
| 9.750 | 2.953 |
| 9.875 | 2.765 |
| 10.000 | 2.515 |
| 10.125 | 2.234 |
| 10.250 | 1.890 |
| 10.375 (INSIDE) | 1.469 |

TABLE 2

| 400 W Internal Reflective Wall 18: | |
|---|---|
| depth from top of reflector (inches) | radius from vertical axis (inches) |
| 0.000 | 7.375 |
| 0.250 | ↓ |
| 0.500 | ↓ |
| 0.750 | ↓ |
| 1.000 | ↓ |
| 1.250 | ↓ |
| 1.500 | ↓ |
| 1.750 | ↓ |
| 2.000 | ↓ |
| 2.250 | conical |
| 2.500 | ↑ |
| 2.750 | ↑ |
| 3.000 | ↑ |
| 3.250 | ↑ |
| 3.500 | ↑ |
| 3.750 | ↑ |
| 4.000 | ↑ |
| 4.250 | ↑ |
| 4.500 | ↑ |
| 4.750 | ↑ |
| 5.000 | 6.796 |
| 5.250 | ↓ |
| 5.500 | ↓ |
| 5.750 | ↓ |
| 6.000 | ↓ |
| 6.250 | conical |
| 6.500 | ↑ |
| 6.750 | ↑ |
| 7.000 | ↑ |
| 7.250 | ↑ |
| 7.500 | ↑ |
| 7.750 | ↑ |
| 8.000 | ↑ |
| 8.125 | 6.234 |

TABLE 2-continued

| 400 W Internal Reflective Wall 18: | |
|---|---|
| depth from top of reflector (inches) | radius from vertical axis (inches) |
| 8.250 | 6.208 |
| 8.500 | 6.156 |
| 8.750 | 6.098 |
| 9.000 | 6.031 |
| 9.250 | 5.953 |
| 9.500 | 5.875 |
| 9.750 | 5.776 |
| 10.000 | 5.645 |
| 10.250 | 5.500 |
| 10.500 | 5.320 |
| 10.750 | 5.125 |
| 11.000 | 4.880 |
| 11.250 | 4.600 |
| 11.500 | 4.312 |
| 11.750 | 4.000 |
| 11.875 | 3.849 |
| 12.000 | 3.656 |
| 12.125 | 3.473 |
| 12.250 | 3.265 |
| 12.375 | 3.055 |
| 12.500 | 2.805 |
| 12.625 | 2.484 |
| 12.750 (INSIDE) | 2.094 |

I claim:

1. A lighting unit adapted to be mounted below eye level for indirect illumination of a work surface comprising a generally elongated bowl-shaped symmetrical reflector having a lower arcuate portion with a sharp radial sweep and a substantially frustoconical upper portion, said reflector having a reflective surface contoured to direct generally upward, in a predetermined pattern, light rays emanating from a light source within said reflector, said light source being centrally disposed with respect to the vertical axis and below the midpoint of said lighting unit, said reflective surface being the circumferential internal wall of said reflector whereby said reflective surface generally directs reflected light rays away from said vertical axis at predetermined angles for reflection by a ceiling surface spaced above said lighting unit to provide for illumination of said work surface and whereby, beyond a maximum predetermined angle, substantially no light rays are reflected from said reflective surface toward said ceiling surface, so that glare interference in the illuminated area is reduced.

2. A lighting unit according to claim 1 wherein said reflective surface reflects said light rays striking it upward toward said ceiling surface at angles no greater than 65° as measured from said vertical axis, said upper frustoconical portion and lower arcuate portion being contoured to reflect said light rays at said above-mentioned angles by varying the radius with respect to the depth of the reflector as set forth in the table below:

| depth from top of reflector (inches) | radius from vertical axis (inches) |
|---|---|
| 0.000 | 6.078 |
| 0.250 | ↓ |
| 0.500 | ↓ |
| 0.750 | ↓ |
| 1.000 | ↓ |
| 1.250 | ↓ |
| 1.500 | ↓ |
| 1.750 | ↓ |
| 2.000 | ↓ |
| 2.250 | ↓ |

-continued

| depth from top of reflector (inches) | radius from vertical axis (inches) |
|---|---|
| 2.500 | ↓ |
| 2.750 | ↓ |
| 3.000 | frustoconical |
| 3.250 | ↑ |
| 3.500 | ↑ |
| 3.750 | ↑ |
| 4.000 | ↑ |
| 4.250 | ↑ |
| 4.500 | ↑ |
| 4.750 | ↑ |
| 5.000 | ↑ |
| 5.250 | ↑ |
| 5.500 | ↑ |
| 5.750 | ↑ |
| 6.000 | 5.015 |
| 6.250 | 4.975 |
| 6.500 | 4.930 |
| 6.750 | 4.875 |
| 7.000 | 4.820 |
| 7.250 | 4.757 |
| 7.500 | 4.680 |
| 7.750 | 4.593 |
| 8.000 | 4.484 |
| 8.250 | 4.359 |
| 8.500 | 4.209 |
| 8.750 | 4.031 |
| 9.000 | 3.835 |
| 9.250 | 3.593 |
| 9.500 | 3.296 |
| 9.750 | 2.953 |
| 9.875 | 2.765 |
| 10.000 | 2.515 |
| 10.125 | 2.234 |
| 10.250 | 1.890 |
| 10.375 (INSIDE) | 1.469 |

3. A lighting unit according to claim 1 wherein said reflective surface reflects said light rays striking it upward toward said ceiling surface at angles no greater than 65° as measured from said vertical axis, said upper frustoconical portion having first and second frustoconical surfaces, said upper frustoconical portion and lower arcuate portion being contoured to reflect said light rays at said above-mentioned angles by varying the radius with respect to the depth of the reflector as set forth in the table below:

| depth from top of reflector (inches) | radius from vertical axis (inches) |
|---|---|
| 0.000 | 7.375 |
| 0.250 | ↓ |

-continued

| depth from top of reflector (inches) | radius from vertical axis (inches) |
|---|---|
| 0.500 | ↓ |
| 0.750 | ↓ |
| 1.000 | ↓ |
| 1.250 | ↓ |
| 1.500 | ↑ |
| 1.750 | ↑ |
| 2.000 | ↑ |
| 2.250 | frustoconical |
| 2.500 | ↑ |
| 2.750 | ↑ |
| 3.000 | ↑ |
| 3.250 | ↑ |
| 3.500 | ↑ |
| 3.750 | ↑ |
| 4.000 | ↑ |
| 4.250 | ↑ |
| 4.500 | ↑ |
| 4.750 | ↑ |
| 5.000 | 6.796 |
| 5.250 | ↓ |
| 5.500 | ↓ |
| 5.750 | ↓ |
| 6.000 | ↓ |
| 6.250 | ↓ |
| 6.500 | frustoconical |
| 6.750 | ↑ |
| 7.000 | ↑ |
| 7.250 | ↑ |
| 7.500 | ↑ |
| 7.750 | ↑ |
| 8.000 | ↑ |
| 8.125 | 6.234 |
| 8.250 | 6.280 |
| 8.500 | 6.156 |
| 8.750 | 6.098 |
| 9.000 | 6.031 |
| 9.250 | 5.953 |
| 9.500 | 5.875 |
| 9.750 | 5.776 |
| 10.000 | 5.645 |
| 10.250 | 5.550 |
| 10.500 | 5.320 |
| 10.750 | 5.125 |
| 11.000 | 4.880 |
| 11.250 | 4.600 |
| 11.500 | 4.312 |
| 11.750 | 4.000 |
| 11.875 | 3.849 |
| 12.000 | 3.656 |
| 12.125 | 3.473 |
| 12.250 | 3.265 |
| 12.375 | 3.055 |
| 12.500 | 2.805 |
| 12.625 | 2.484 |
| 12.750 (INSIDE) | 2.094 |

4. A lighting unit according to claims 2, 3 or 1 wherein said lighting unit is adapted to emit maximum light intensity between 0° and 20° of said vertical axis.

* * * * *